US009704423B2

(12) United States Patent
Xiao

(10) Patent No.: US 9,704,423 B2
(45) Date of Patent: Jul. 11, 2017

(54) DRIVING CIRCUIT

(71) Applicant: Shenzhen China Star Optoelectronics Technology Co., Ltd., Shenzhen (CN)

(72) Inventor: Juncheng Xiao, Shenzhen (CN)

(73) Assignee: SHENZHEN CHINA STAR OPTOELECTRONICS TECHNOLOGY CO., LTD., Shenzhen (CN)

( * ) Notice: Subject to any disclaimer, the term of this patent is extended or adjusted under 35 U.S.C. 154(b) by 92 days.

(21) Appl. No.: 14/417,154

(22) PCT Filed: Dec. 29, 2014

(86) PCT No.: PCT/CN2014/095359
§ 371 (c)(1),
(2) Date: Jan. 25, 2015

(87) PCT Pub. No.: WO2016/101293
PCT Pub. Date: Jun. 30, 2016

(65) Prior Publication Data

US 2016/0189584 A1 Jun. 30, 2016

(30) Foreign Application Priority Data

Dec. 24, 2014 (CN) ..... 2014 1 0813921

(51) Int. Cl.
*G09G 3/20* (2006.01)
*G09G 3/3266* (2016.01)
*G09G 3/36* (2006.01)

(52) U.S. Cl.
CPC ..... *G09G 3/20* (2013.01); *G09G 3/3266* (2013.01); *G09G 3/3677* (2013.01); *G09G 2300/0408* (2013.01); *G09G 2310/0283* (2013.01)

(58) Field of Classification Search
CPC ..... G09G 2310/0283; G09G 3/3677; G09G 3/3266; G09G 2300/0408; G09G 3/20
See application file for complete search history.

(56) References Cited

U.S. PATENT DOCUMENTS

2010/0259530 A1 10/2010 Chang et al.
2012/0008731 A1 1/2012 Hsu
2012/0050234 A1* 3/2012 Jang ..... G09G 3/3225 345/204

(Continued)

FOREIGN PATENT DOCUMENTS

CN 102214428 A 10/2011
CN 102842278 A 12/2012

(Continued)

*Primary Examiner* — Alexander Eisen
*Assistant Examiner* — Abhishek Sarma
(74) *Attorney, Agent, or Firm* — JMB Davis Ben-David

(57) ABSTRACT

A driving circuit is disclosed. The driving circuit includes at least four drivers. Each of the drivers includes a scan direction control unit, a driving signal output unit, a first, second, and third control units, and a signal output interface. The scan direction control unit is utilized for controlling the driving signal output unit to output the driving signal. The first control unit, the second control unit, and the third control unit are commonly utilized for controlling the driving signal output unit. The present invention can scan in two directions including a forward direction and a reverse direction.

14 Claims, 6 Drawing Sheets

(56) References Cited

U.S. PATENT DOCUMENTS

| | | | |
|---|---|---|---|
| 2014/0119490 | A1 | 5/2014 | Yang et al. |
| 2014/0253424 | A1 | 9/2014 | Yu et al. |
| 2016/0180788 | A1 | 6/2016 | Xiao |

FOREIGN PATENT DOCUMENTS

| | | | |
|---|---|---|---|
| CN | 102903322 | A | 1/2013 |
| CN | 104575420 | A | 4/2015 |

* cited by examiner

DRIVING CIRCUIT

CROSS-REFERENCE TO RELATED APPLICATIONS

This is the U.S. National Stage of International Application No. PCT/CN2014/095359, filed Dec. 29, 2014, which in turn claims the benefit of China Patent Application No. 201410813921.X, filed Dec. 24, 2014.

BACKGROUND OF THE INVENTION

1. Field of the Invention

The present invention generally relates to a driving technical field, and more particularly to a driving circuit for a display panel.

2. Description of Prior Art

In a conventional GOA (gate driver on array) technical scheme, a scan driving circuit is formed on a thin film transistor array substrate with a current process for manufacturing the thin film transistor array substrate, thereby implementing to scan a pixel array on the thin film transistor array substrate line by line.

In a technical scheme of a conventional scan driving circuit, pixel units are controlled to be scanned in a unidirectional manner, that is, scanned in a single sequence.

However, in the technical scheme of the conventional scan driving circuit with the unidirectional manner, the scan driving circuit and/or the thin film transistor array substrate are easily damaged. It is difficult to repair the scan driving circuit and/or the thin film transistor array substrate after the scan driving circuit and/or the thin film transistor array substrate are damaged.

Consequently, there is a need to provide a new technical scheme for solving the above-mentioned problems in the prior art.

SUMMARY OF THE INVENTION

An objective of the present invention is to provide a driving circuit which can scan in two directions including a forward direction and a reverse direction and guarantee the stability when the driving circuit is operated in a long time.

To solve the above-mentioned problems, a technical scheme of the present invention is described as follows. A driving circuit comprises: at least four drivers, the at least four drivers are electrically coupled in a predetermined sequence, the at least four drivers are utilized for generating driving signals in the predetermined sequence and in a sequence opposite to the predetermined sequence and outputting the driving signals, each of the drivers comprises: a scan direction control unit; a driving signal output unit; a first control unit; a second control unit; a third control unit; and a signal output interface. The scan direction control unit is electrically coupled to the second control unit, and the second control unit is electrically coupled to the driving signal output unit, the first control unit, and the third control unit. The driving signal output unit is utilized for receiving a first clock signal and outputting the driving signal. The scan direction control unit is utilized for controlling the driving signal output unit to output the driving signal according to an arranged sequence of said driver in the at least four drivers. The first control unit, the second control unit, and the third control unit are commonly utilized for controlling the driving signal output unit. The scan direction control unit is utilized for receiving a first control signal. A second control signal, a first input signal, and a second input signal and utilized for outputting the first input signal or the second input signal according to the first control signal and the second control signal. The scan direction control unit comprises a first switch and a second switch. A first control end of the first switch is utilized for receiving the first control signal and utilized for controlling a turning on and a turning off of a first current path between a first input end and a first output end of the first switch according to the first control signal. A second control end of the second switch is utilized for receiving the second control signal and utilized for controlling a turning on and a turning off of a second current path between a second input end and a second output end of the second switch according to the second control signal. The first input end is utilized for receiving the first input signal, and the second input end is utilized for receiving the second input signal. The first output end is utilized for outputting the first input signal when the first current path is turned on. The second output end is utilized for outputting the second input signal when the second current path is turned on. The first output end of the first switch is electrically coupled to the second output end of the second switch, and the first output end is further electrically coupled to the second control unit. The second control unit comprises: a third switch, a third control end of the third switch is utilized for receiving a second clock signal and utilized for controlling a turning on and a turning off of a third current path between a third input end and a third output end of the third switch according to the second clock signal; the third input end is electrically coupled to the first output end, the third output end is electrically coupled to the driving signal output unit, and the third output end is utilized for outputting the first input signal or the second input signal when the third current path is turned on.

In the above-mentioned driving circuit, the first control signal is a first scan direction control signal, the second control signal is a second scan direction control signal, the first input signal is a driving signal outputted by a previous driver adjacent to said driver in the predetermined sequence, and the second input signal is a driving signal outputted by a next driver adjacent to said driver in the predetermined sequence; or the first control signal is the driving signal outputted by the previous driver adjacent to said driver in the predetermined sequence, the second control signal is the driving signal outputted by the next driver adjacent to said driver in the predetermined sequence, the first input signal is the first scan direction control signal, and the second input signal is the second scan direction control signal.

In the above-mentioned driving circuit, the driving signal output unit comprises: a fourth switch, a fourth control end of the fourth switch is electrically coupled to the third output end, the fourth control end is utilized for receiving the first input signal or the second input signal from the third output end and utilized for controlling a turning on and a turning off of a fourth current path between a fourth input end and a fourth output end of the fourth switch according to the first input signal or the second input signal; the fourth input end is utilized for receiving the first clock signal; the fourth output end is electrically coupled to the signal output interface, and the fourth output end is utilized for outputting the first clock signal to the signal output interface when the fourth current path is turned on; the first control unit comprises a first capacitor, a first plate of the first capacitor is electrically coupled to the fourth control end, and a second plate of the first capacitor is electrically coupled to the fourth output end; the first capacitor is utilized for receiving the first input signal or the second input signal, storing the first input signal or the second input signal, receiving the driving signal, and combining the driving signal with the first input signal or the second input signal to generate a third control signal, and the third control signal is utilized for controlling the turning on and the turning off the fourth current path.

In the above-mentioned driving circuit, the third control unit comprises a fifth switch, a sixth switch, a seventh switch, an eighth switch, and a second capacitor; an eighth control end of the eighth switch is utilized for receiving a third clock signal and utilized for controlling a turning on and a turning off of an eighth current path between an eighth input end and an eighth output end of the eighth switch according to the third clock signal, the eighth input end is utilized for receiving a low voltage signal, and the eighth output end is electrically coupled to a fifth control end of the fifth switch, and the eighth output end is utilized for outputting the low voltage signal when the eighth current path is turned on; a seventh control end of the seventh switch is electrically coupled to the third output end, the seventh control end is utilized for receiving the first input signal or the second input signal outputted by the third output end and utilized for controlling a turning on and a turning off of a seventh current path between a seventh input end and a seventh output end according to the first input signal or the second input signal, and the seventh input end is utilized for receiving a high voltage signal; the seventh output end is electrically coupled to the fifth control end, and the seventh output end is utilized for outputting the high voltage signal when the seventh current path is turned on; the fifth control end of the fifth switch is utilized for receiving the high voltage signal or the low voltage signal and utilized for controlling a turning on and a turning off of a fifth current path between a fifth input end and a fifth output end of the fifth switch according to the high voltage signal or the low voltage signal, the fifth input end is electrically coupled to the seventh input end, the fifth input end is utilized for receiving the high voltage signal, the fifth output end is electrically coupled to the fourth control end, and the fifth output end is utilized for outputting the high voltage signal when the fifth current path is turned on; a sixth control end of the sixth switch is electrically coupled to the fifth control end, the sixth control end is utilized for receiving the high voltage signal or the low voltage signal and utilized for controlling a turning on and a turning off of a sixth current path between a sixth input end and a sixth output end of the sixth switch according to the high voltage signal or the low voltage signal; the sixth input end of the sixth switch is electrically coupled to the seventh input end, the sixth input end is utilized for receiving the high voltage signal, the sixth output end of the sixth switch is electrically coupled to the signal output interface, and the sixth output end is utilized for outputting the high voltage signal when the sixth current path is turned on; a third plate of the second capacitor is electrically coupled to the sixth control end, and a fourth plate of the second capacitor is electrically coupled to the sixth input end.

In the above-mentioned driving circuit, the third control unit further comprises a ninth switch; a ninth control end of the ninth switch is utilized for receiving a fourth clock signal and utilized for controlling a turning on and a turning off of a ninth current path between a ninth input end and a ninth output end of the ninth switch according to the fourth clock signal; the ninth input end is electrically coupled to the eighth input end, the ninth output end is electrically coupled to the eighth output end, and the ninth output end is utilized for outputting the low voltage signal when the ninth current path is turned on; the second control unit comprises: a tenth switch, a tenth input end of the tenth switch is electrically coupled to the first output end, a tenth control end of the tenth switch is electrically coupled to the tenth input end, and a tenth output end of the tenth switch is electrically coupled to the third input end of the third switch.

A driving circuit comprises: at least four drivers, the at least four drivers are electrically coupled in a predetermined sequence, the at least four drivers are utilized for generating driving signals in the predetermined sequence and in a sequence opposite to the predetermined sequence and outputting the driving signals, each of the drivers comprises: a scan direction control unit; a driving signal output unit; a first control unit; a second control unit; a third control unit; and a signal output interface, wherein the scan direction control unit is electrically coupled to the second control unit, and the second control unit is electrically coupled to the driving signal output unit, the first control unit, and the third control unit; the driving signal output unit is utilized for receiving a first clock signal and outputting the driving signal; the scan direction control unit is utilized for controlling the driving signal output unit to output the driving signal according to an arranged sequence of said driver in the at least four drivers; the first control unit, the second control unit, and the third control unit are commonly utilized for controlling the driving signal output unit.

In the above-mentioned driving circuit, the scan direction control unit is utilized for receiving a first control signal, a second control signal, a first input signal, and a second input signal and utilized for outputting the first input signal or the second input signal according to the first control signal and the second control signal.

In the above-mentioned driving circuit, the scan direction control unit comprises a first switch and a second switch; a first control end of the first switch is utilized for receiving the first control signal and utilized for controlling a turning on and a turning off of a first current path between a first input end and a first output end of the first switch according to the first control signal; a second control end of the second switch is utilized for receiving the second control signal and utilized for controlling a turning on and a turning off of a second current path between a second input end and a second output end of the second switch according to the second control signal; the first input end is utilized for receiving the first input signal, and the second input end is utilized for receiving the second input signal; the first output end is utilized for outputting the first input signal when the first current path is turned on; the second output end is utilized for outputting the second input signal when the second current path is turned on; the first output end of the first switch is electrically coupled to the second output end of the second switch, and the first output end is further electrically coupled to the second control unit.

In the above-mentioned driving circuit, the first control signal is a first scan direction control signal, the second control signal is a second scan direction control signal, the first input signal is a driving signal outputted by a previous driver adjacent to said driver in the predetermined sequence, and the second input signal is a driving signal outputted by a next driver adjacent to said driver in the predetermined sequence; or the first control signal is the driving signal outputted by the previous driver adjacent to said driver in the predetermined sequence, the second control signal is the driving signal outputted by the next driver adjacent to said driver in the predetermined sequence, the first input signal is the first scan direction control signal, and the second input signal is the second scan direction control signal.

In the above-mentioned driving circuit, the second control unit comprises: a third switch, a third control end of the third switch is utilized for receiving a second clock signal and utilized for controlling a turning on and a turning off of a third current path between a third input end and a third output end of the third switch according to the second clock signal; the third input end is electrically coupled to the first output end, the third output end is electrically coupled to the driving signal output unit, and the third output end is utilized for outputting the first input signal or the second input signal when the third current path is turned on.

In the above-mentioned driving circuit, the driving signal output unit comprises: a fourth switch, a fourth control end of the fourth switch is electrically coupled to the third output end, the fourth control end is utilized for receiving the first input signal or the second input signal from the third output end and utilized for controlling a turning on and a turning off of a fourth current path between a fourth input end and a fourth output end of the fourth switch according to the first input signal or the second input signal; the fourth input end is utilized for receiving the first clock signal; the fourth output end is electrically coupled to the signal output interface, and the fourth output end is utilized for outputting the first clock signal to the signal output interface when the fourth current path is turned on.

In the above-mentioned driving circuit, the first control unit comprises a first capacitor, a first plate of the first capacitor is electrically coupled to the fourth control end, and a second plate of the first capacitor is electrically coupled to the fourth output end; the first capacitor is utilized for receiving the first input signal or the second input signal, storing the first input signal or the second input signal, receiving the driving signal, and combining the driving signal with the first input signal or the second input signal to generate a third control signal, and the third control signal is utilized for controlling the turning on and the turning off the fourth current path.

In the above-mentioned driving circuit, the third control unit comprises a fifth switch, a sixth switch, a seventh switch, an eighth switch, and a second capacitor; an eighth control end of the eighth switch is utilized for receiving a third clock signal and utilized for controlling a turning on and a turning off of an eighth current path between an eighth input end and an eighth output end of the eighth switch according to the third clock signal, the eighth input end is utilized for receiving a low voltage signal, and the eighth output end is electrically coupled to a fifth control end of the fifth switch, and the eighth output end is utilized for outputting the low voltage signal when the eighth current path is turned on; a seventh control end of the seventh switch is electrically coupled to the third output end, the seventh control end is utilized for receiving the first input signal or the second input signal outputted by the third output end and utilized for controlling a turning on and a turning off of a seventh current path between a seventh input end and a seventh output end according to the first input signal or the second input signal, and the seventh input end is utilized for receiving a high voltage signal; the seventh output end is electrically coupled to the fifth control end, and the seventh output end is utilized for outputting the high voltage signal when the seventh current path is turned on; the fifth control end of the fifth switch is utilized for receiving the high voltage signal or the low voltage signal and utilized for controlling a turning on and a turning off of a fifth current path between a fifth input end and a fifth output end of the fifth switch according to the high voltage signal or the low voltage signal, the fifth input end is electrically coupled to the seventh input end, the fifth input end is utilized for receiving the high voltage signal, the fifth output end is electrically coupled to the fourth control end, and the fifth output end is utilized for outputting the high voltage signal when the fifth current path is turned on; a sixth control end of the sixth switch is electrically coupled to the fifth control end, the sixth control end is utilized for receiving the high voltage signal or the low voltage signal and utilized for controlling a turning on and a turning off of a sixth current path between a sixth input end and a sixth output end of the sixth switch according to the high voltage signal or the low voltage signal; the sixth input end of the sixth switch is electrically coupled to the seventh input end, the sixth input end is utilized for receiving the high voltage signal, the sixth output end of the sixth switch is electrically coupled to the signal output interface, and the sixth output end is utilized for outputting the high voltage signal when the sixth current path is turned on; a third plate of the second capacitor is electrically coupled to the sixth control end, and a fourth plate of the second capacitor is electrically coupled to the sixth input end.

In the above-mentioned driving circuit, the second plate is further electrically coupled to the sixth output end; the second plate is further utilized for receiving the high voltage signal from the sixth output end and neutralizing electric charges corresponding to the high voltage signal and electric charges corresponding to the first input signal or the second input signal received by the first plate, so as to generate the third control signal and control a voltage potential at a first predetermined position in a connection between the driving signal output unit and the scan direction control unit.

In the above-mentioned driving circuit, the third plate is utilized for receiving electric charges corresponding to the low voltage signal, the fourth plate is utilized for receiving electric charges corresponding to the high voltage signal, a fourth control signal is generated after the electric charges in the third plate and the electric charges in the fourth plate are neutralized, and the fourth control signal is utilized for controlling the turning on and the turning off of the sixth current path.

In the above-mentioned driving circuit, the second capacitor is further utilized for storing electric charges of the low voltage signal inputted by the eighth switch and utilized for increasing a voltage potential of a second predetermined position between the eighth output end and the sixth control end by using the stored electric charges.

In the above-mentioned driving circuit, a signal to be received by the eighth control end of the eighth switch and a signal to be received by the third control end of the third switch are exchanged.

In the above-mentioned driving circuit, the third control unit further comprises a ninth switch; a ninth control end of the ninth switch is utilized for receiving a fourth clock signal and utilized for controlling a turning on and a turning off of a ninth current path between a ninth input end and a ninth output end of the ninth switch according to the fourth clock signal; the ninth input end is electrically coupled to the eighth input end, the ninth output end is electrically coupled to the eighth output end, and the ninth output end is utilized for outputting the low voltage signal when the ninth current path is turned on.

In the above-mentioned driving circuit, the second control unit comprises: a tenth switch, a tenth input end of the tenth switch is electrically coupled to the first output end, a tenth control end of the tenth switch is electrically coupled to the tenth input end, and a tenth output end is electrically coupled to the third input end of the third switch.

In the above-mentioned driving circuit, the second control unit is further utilized for avoiding and decreasing a leakage current at a first predetermined position of a connection between the driving signal output unit and the scan direction control unit.

Comparing with prior art, the present invention can scan in two directions including a forward direction and a reverse direction and guarantee the stability when the driving circuit is operated in a long time.

For a better understanding of the aforementioned content of the present invention, preferable embodiments are illustrated in accordance with the attached figures for further explanation.

DETAILED DESCRIPTION OF THE INVENTION

The term "embodiment" in the specification refers to an implementation or an example of one or more of the inventions. Furthermore, as used in the description herein and throughout the claims that follow, the meaning of "a" includes plural reference unless the context clearly dictates otherwise.

A driving circuit of the present invention is adapted for a display panel, such as a TFT-LCD (Thin Film Transistor Liquid Crystal Display, an OLED (Organic Light Emitting Diode), and so on, so as to provide driving signals (scan signals) for the display panel.

The driving circuit of the present invention comprises at least four drivers. The at least four drivers are electrically coupled in a predetermined sequence. The at least four drivers are utilized for generating driving signals in the predetermined sequence and in a sequence opposite to the predetermined sequence and outputting the driving signals. Each of the drivers is electrically coupled to a scan line of one row of pixels. The driving signals outputted by the drivers are utilized for scanning (driving) corresponding pixels via the corresponding scan line.

For example, the at least four drivers comprise a first driver, a second driver, a third driver, and a fourth driver. The predetermined sequence is a sequence in which the first driver, the second driver, the third driver, and the fourth driver are successively arranged.

In the at least four drivers, two adjacent drivers of the first driver, the second driver, the third driver, and the fourth driver are electrically coupled. Two drivers, which are separated by one or two of the other two drivers, of the first driver, the second driver, the third driver, and the fourth driver are electrically coupled. For example, the third driver is electrically coupled to the second driver and the fourth driver which are adjacent to the third driver. The third driver is electrically coupled to the first driver which is separated by one of the drivers.

Figure 1:
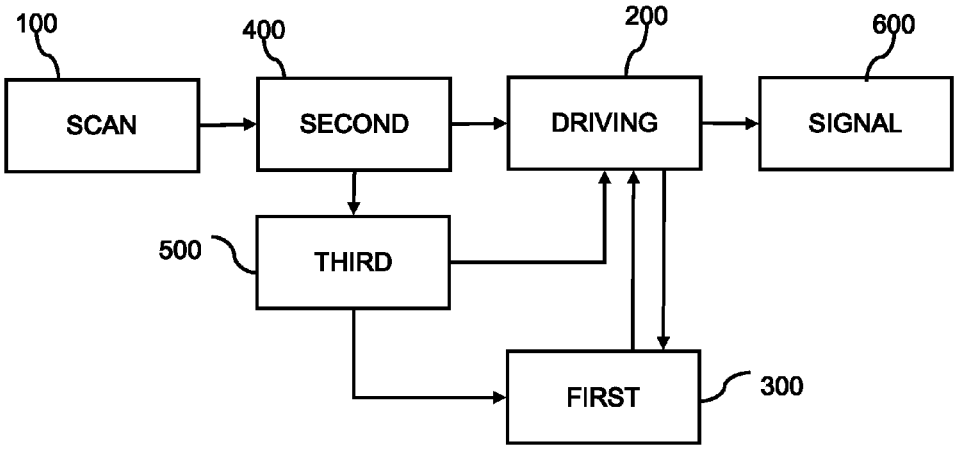
FIG. 1 shows a block diagram of the driving circuit in accordance with the present invention.
Figure 2:
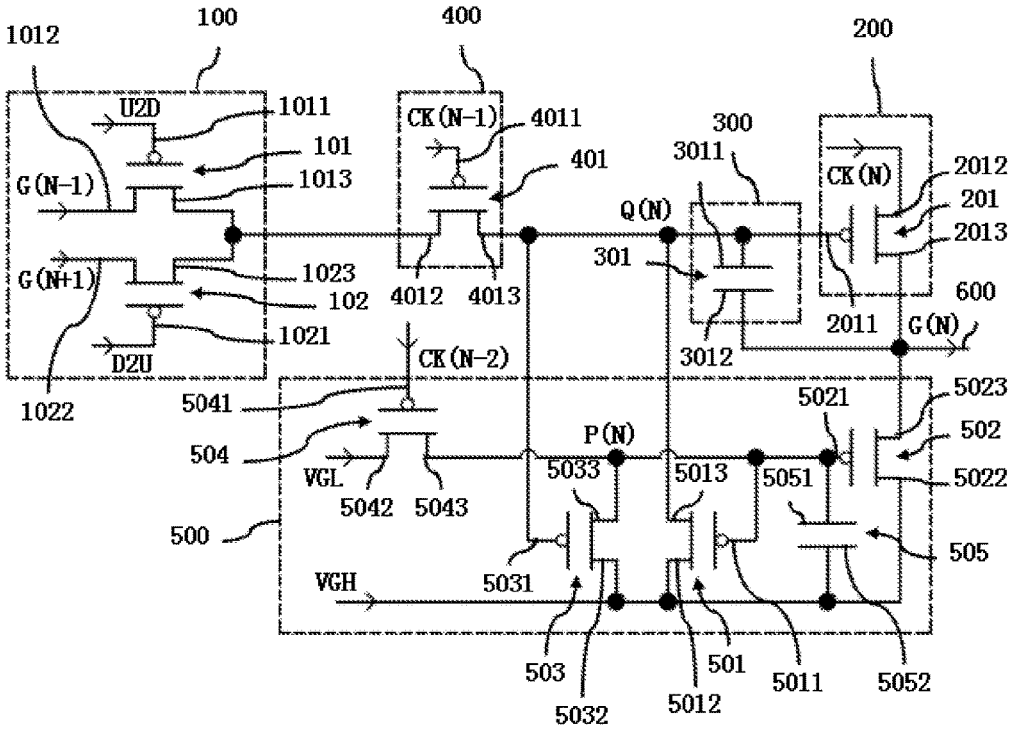
FIG. 2 shows a circuit diagram of the driving circuit in FIG. 1 in accordance with the first embodiment.
Figure 5:
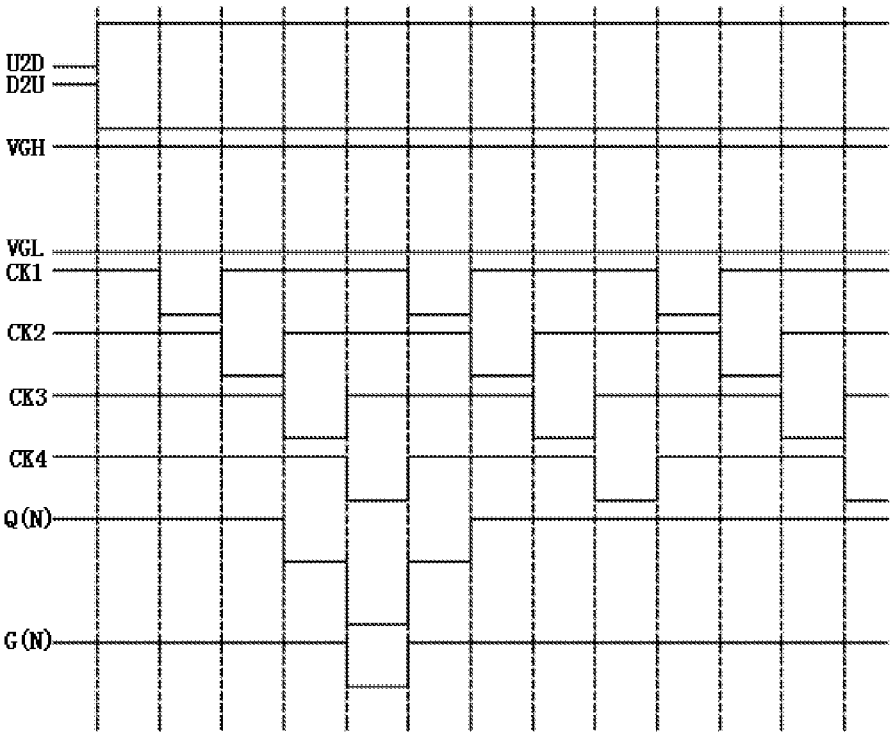
FIG. 5 shows waveforms corresponding to the first to fourth embodiments in accordance with the driving circuit of the present invention.

Please refer to FIG. 1, FIG. 2, and FIG. 5. FIG. 1 shows a block diagram of the driving circuit in accordance with the present invention. FIG. 2 shows a circuit diagram of the driving circuit in FIG. 1 in accordance with the first embodiment. FIG. 5 shows waveforms corresponding to the first to fourth embodiments in accordance with the driving circuit of the present invention.

In the present embodiment, the driver comprises a scan direction control unit 100, a driving signal output unit 200, a first control unit 300, a second control unit 400, a third control unit 500, and a signal output interface 600.

The scan direction control unit 100 is electrically coupled to the second control unit 400. The second control unit 400 is electrically coupled to the driving signal output unit 200, the first control unit 300, and the third control unit 500. The driving signal output unit 200 is utilized for receiving a first clock signal CK(N) and outputting a driving signal G(N). The scan direction control unit 100 is utilized for controlling the driving signal output unit 200 to output the driving signal G(N) according to an arranged sequence of said driver in the at least four drivers. The first control unit 300, the second control unit 400, and the third control unit 500 are commonly utilized for controlling the driving signal output unit 200.

Specifically, in the present embodiment, the scan direction control unit 100 is utilized for receiving a first control signal, a second control signal, a first input signal, and a second input signal and utilized for outputting the first input signal or the second input signal according to the first control signal and the second control signal.

In the driving circuit, an (N−2)th driver (for example, the first driver), an (N−1)th driver (for example, the second driver), an Nth driver (for example, the third driver), and an (N+1)th driver (for example, the fourth driver) are arranged in the predetermined sequence. As an example, the Nth driver is described as follows. In FIG. 5, CK1, CK2, CK3, and CK4 are four clock signals with an identical period. CK(N−3), CK(N−2), CK(N−1), and CK(N) may be one of CK1, CK2, CK3, and CK4.

In the present embodiment, the scan direction control unit 100 comprises a first switch 101 and a second switch 102.

A first control end 1011 of the first switch 101 is utilized for receiving the first control signal and utilized for controlling a turning on and a turning off of a first current path between a first input end 1012 and a first output end 1013 of the first switch 101 according to the first control signal. A second control end 1021 of the second switch 102 is utilized for receiving the second control signal and utilized for controlling a turning on and a turning off of a second current path between a second input end 1022 and a second output end 1023 of the second switch 102 according to the second control signal.

The first input end 1012 is utilized for receiving the first input signal. The second input end 1022 is utilized for receiving the second input signal.

The first output end 1013 is utilized for outputting the first input signal when the first current path is turned on. The second output end 1023 is utilized for outputting the second input signal when the second current path is turned on.

The first output end 1013 is electrically coupled to the second output end 1023. The first output end 1013 is further electrically coupled to the second control unit 400.

In the present embodiment, the first control signal is a first scan direction control signal U2D, and the second control signal is a second scan direction control signal D2U. The first input signal is a driving signal outputted by a previous driver adjacent to said driver in the predetermined sequence, that is, the driving signal G(N−1) outputted by the (N−1)th driver. The second input signal is a driving signal outputted by a next driver adjacent to said driver in the predetermined sequence, that is, the driving signal G(N+1) outputted by the (N+1)th driver.

In the present embodiment, the driving signal output unit 200 comprises a fourth switch 201. A fourth control end 2011 of the fourth switch 201 is electrically coupled to a third output end 4013 of a third switch 401. The fourth control end 2011 is utilized for receiving the first input signal or the second input signal from the third output end 4013 and utilized for controlling a turning on and a turning off of a fourth current path between a fourth input end 2012 and a fourth output end 2013 of the fourth switch 201 according to the first input signal or the second input signal.

The fourth input end 2012 is utilized for receiving the first clock signal CK(N). The first clock signal CK(N) is a clock signal corresponding to the Nth driver.

The fourth output end 2013 is electrically coupled to the signal output interface 600. The fourth output end 2013 is utilized for outputting the first clock signal CK(N) to the signal output interface 600 when the fourth current path is turned on.

In the present embodiment, the second control unit comprises the third switch 401. A third control end 4011 of the third switch 401 is utilized for receiving the second clock signal CK(N−1) and utilized for controlling a turning on and a turning off of a third current path between a third input end 4012 and the third output end 4013 according to the second clock signal CK(N−1). The second clock signal CK(N−1) is a clock signal corresponding to the (N−1)th driver.

The third input end 4012 is electrically coupled to the first output end 1013. The third output end 4013 is electrically coupled to the driving signal output unit 200. The third output end 4013 is utilized for outputting the first input signal or the second input signal when the third current path is turned on.

In the present embodiment, the second control unit 400 is further utilized for avoiding and decreasing a leakage current at a first predetermined position (for example, the point Q(N) in FIG. 2) of a connection between the driving signal output unit 200 and the scan direction control unit 100.

In the present embodiment, the first control unit 300 comprises a first capacitor 301. A first plate 3011 of the first capacitor 301 is electrically coupled to the fourth control end 2011, and a second plate 3012 of the first capacitor 301 is electrically coupled to the fourth output end 2013.

The first capacitor 301 is utilized for receiving the first input signal or the second input signal, storing the first input signal or the second input signal, receiving the driving signal G(N), and combining the driving signal G(N) with the first input signal or the second input signal to generate a third control signal. The third control signal is utilized for controlling the turning on and the turning off the fourth current path.

In the present embodiment, the third control unit 500 comprises a fifth switch 501, a sixth switch 502, a seventh switch 503, an eighth switch 504, and a second capacitor 505.

An eighth control end 5041 of the eighth switch 504 is utilized for receiving the third clock signal CK(N−2) and utilized for controlling a turning on and a turning off of an eighth current path between an eighth input end 5042 and an eighth output end 5043 according to the third clock signal CK(N−2). The eighth input end 5042 is utilized for receiving a low voltage signal VGL. The eighth output end 5043 is electrically coupled to a fifth control end 5011 of the fifth switch 501. The eighth output end 5043 is utilized for outputting the low voltage signal VGL when the eighth current path is turned on. The third clock signal is a signal corresponding to the (N−2)th driver.

A seventh control end 5031 of the seventh switch 503 is electrically coupled to the third output end 4013. The seventh control end 5031 is utilized for receiving the first input signal or the second input signal outputted by the third output end 4013 and utilized for controlling a turning on and a turning off of a seventh current path between a seventh input end 5032 and a seventh output end 5033 according to the first input signal or the second input signal. The seventh input end 5032 is utilized for receiving a high voltage signal VGH.

The seventh output end 5033 is electrically coupled to the fifth control end 5011. The seventh output end 5033 is utilized for outputting the high voltage signal VGH when the seventh current path is turned on.

The fifth control end 5011 of the fifth switch 501 is utilized for receiving the high voltage signal VGH or the low voltage signal VGL and utilized for controlling a turning on and a turning off of a fifth current path between a fifth input end 5012 and a fifth output end 5013 of the switch 501 according to the high voltage signal VGH or the low voltage signal VGL. The fifth input end 5012 is electrically coupled to the seventh input end 5032. The fifth input end 5012 is utilized for receiving the high voltage signal VGH. The fifth output end 5013 is electrically coupled to the fourth control end 2011. The fifth output end 5013 is utilized for outputting the high voltage signal VGH when the fifth current path is turned on.

A sixth control end 5021 of the sixth switch 502 is electrically coupled to the fifth control end 5011. The sixth control end 5021 is utilized for receiving the high voltage signal VGH or the low voltage signal VGL and utilized for controlling a turning on and a turning off of a sixth current path between a sixth input end 5022 and a sixth output end 5023 of the sixth switch 502 according to the high voltage signal VGH or the low voltage signal VGL.

The sixth input end 5022 is electrically coupled to the seventh input end 5032. The sixth input end 5022 is utilized for receiving the high voltage signal VGH. The sixth output end 5023 of the sixth switch 502 is electrically coupled to the signal output interface 600. The sixth output end 5023 is utilized for outputting the high voltage signal VGH when the sixth current path is turned on.

A third plate 5051 of the second capacitor 505 is electrically coupled to the sixth control end 5021, and a fourth plate 5052 of the second capacitor 505 is electrically coupled to the sixth input end 5022. The second capacitor 505 is utilized for storing electric charges of the low voltage signal VGL inputted by the eighth switch 504. Specifically, the third plate 5051 is utilized for receiving the electric charges corresponding to the low voltage signal VGL, and the fourth plate 5052 is utilized for receiving the electric charges corresponding to the high voltage signal VGH. A fourth control signal is generated after the electric charges in the third plate 5051 and the electric charges in the fourth plate 5052 are neutralized. The fourth control signal is utilized for controlling the turning on and the turning off of the sixth current path. The second capacitor 505 is further utilized for increasing a voltage potential of a second predetermined position (for example, the point P(N))

between the eighth output end 5043 and the sixth control end 5021 by using the stored electric charges.

In the present embodiment, the signal output interface 600 is electrically coupled to a scan line of the display panel and utilized for providing the driving signal G(N) for said scan line. The signal output interface 600 is further electrically coupled to the (N+1)th driver and the (N−1)th driver.

In the present embodiment, the first switch 101, the second switch 102, the third switch 401, the fourth switch 201, the fifth switch 501, the sixth switch 502, the seventh switch 503, and the eighth switch 504 may be transistors, for example, PMOS (Positive channel Metal Oxide Semiconductor) transistors.

In the present embodiment, since the sixth output end 5023 is further electrically coupled to the signal output interface 600, the second plate 3012 is electrically coupled to the sixth output end 5023. The second plate 3012 is further utilized for receiving the high voltage signal VGH and neutralizing the electric charges corresponding to the high voltage signal VGH and the electric charges corresponding to the first input signal or the second input signal received by the first plate 3011, so as to generate the third control signal and control the voltage potential at the first predetermined position (for example, the point Q(N)).

By the above-mentioned technical scheme, the display panel may be scanned in two directions including a forward direction and a reverse direction, and the stability can be guaranteed when the driving circuit is operated in a long time.

Furthermore, turning-on frequencies of the first current path and the second current path can be decreased. That is, the first current path and the second current path are in the turning-off state most of the time, thereby decreasing the leakage current at the first predetermined position (for example, the point Q(N)).

The driving circuit of the present invention in accordance with the second embodiment is similar to that in accordance with the first embodiment. A difference is described as follows. The first control signal is the driving signal G(N−1) outputted by a previous driver adjacent to said driver in the predetermined sequence. The second control signal is the driving signal G(N+1) outputted by a next driver adjacent to said driver in the predetermined sequence. The first input signal is the first scan direction control signal U2D, and the second input signal is the second scan direction control signal D2U.

Figure 3:
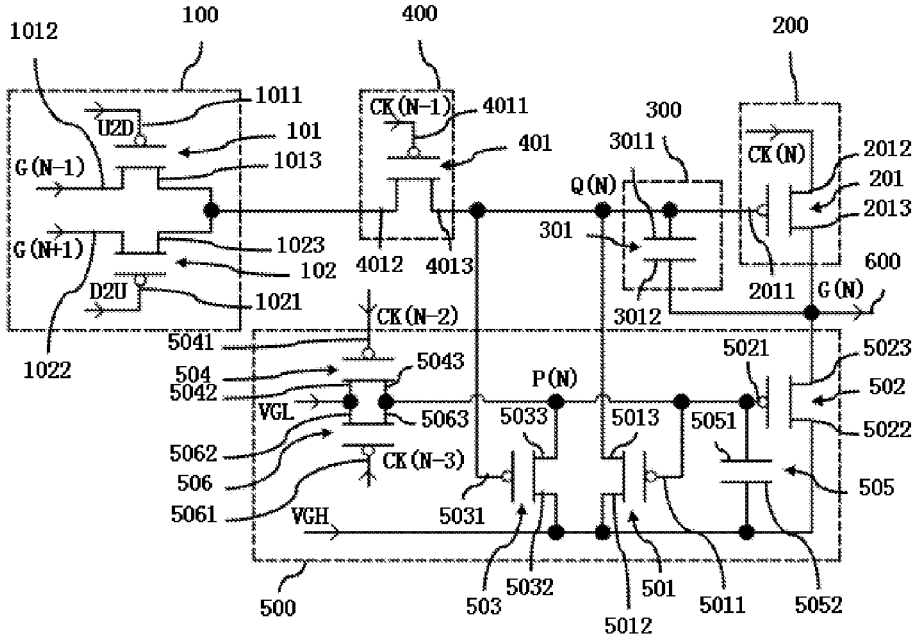
FIG. 3 shows a circuit diagram of the driving circuit in FIG. 1 in accordance with the third embodiment.

Please refer to FIG. 3. FIG. 3 shows a circuit diagram of the driving circuit in FIG. 1 in accordance with the third embodiment. The present embodiment is similar to the first or the second embodiment. A difference is described as follows. In the present embodiment, the third control unit 500 further comprises a ninth switch 506. A ninth control end 5061 of the ninth switch 506 is utilized for receiving the fourth clock signal CK(N−3) and utilized for controlling a turning on and a turning off of a ninth current path between a ninth input end 5062 and a ninth output end 5063 of the ninth switch 506 according to the fourth clock signal CK(N−3). The fourth clock signal CK(N−3) is a clock signal corresponding to the (N−3)th driver.

The ninth input end 5062 is electrically coupled to the eighth input end 5042. The ninth output end 5063 is electrically coupled to the eighth output end 5043. The ninth output end 5063 is utilized for outputting the low voltage signal VGL when the ninth current path is turned on.

The ninth switch 506 may be a transistor as well, for example, a PMOS transistor.

Figure 4:
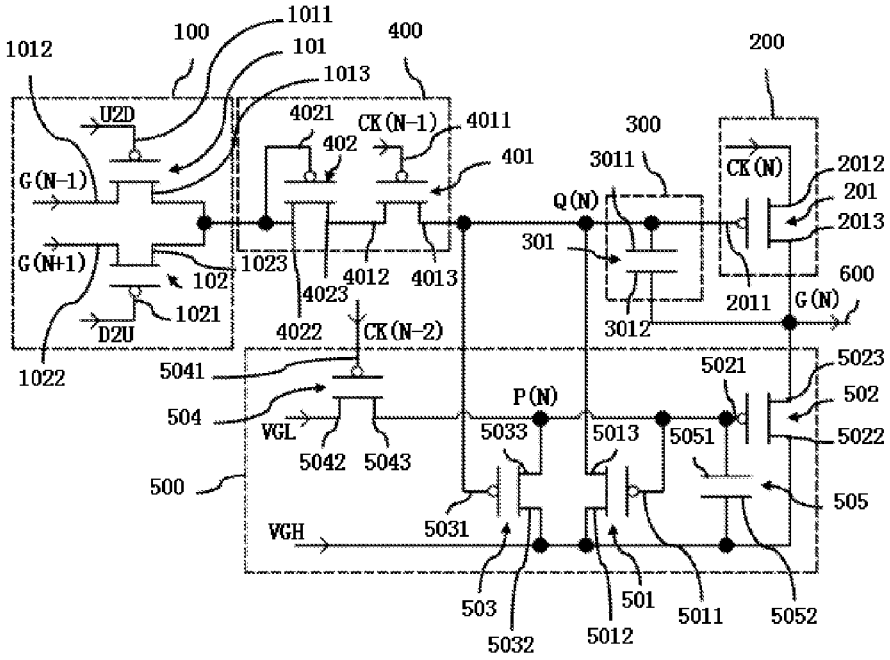
FIG. 4 shows a circuit diagram of the driving circuit in FIG. 1 in accordance with the fourth embodiment.

Please refer to FIG. 4. FIG. 4 shows a circuit diagram of the driving circuit in FIG. 1 in accordance with the fourth embodiment. The present embodiment is similar to one of the first to the third embodiments. A difference is described as follows. In the present embodiment, the second control unit 400 comprises a tenth switch 402. A tenth input end 4022 of the tenth switch 402 is electrically coupled to the first output end 1013. A tenth control end 4021 of the tenth switch 402 is electrically coupled to the tenth input end 4022. A tenth output end 4023 of the tenth switch 402 is electrically coupled to the third input end 4012 of the third switch 401.

Figure 6:
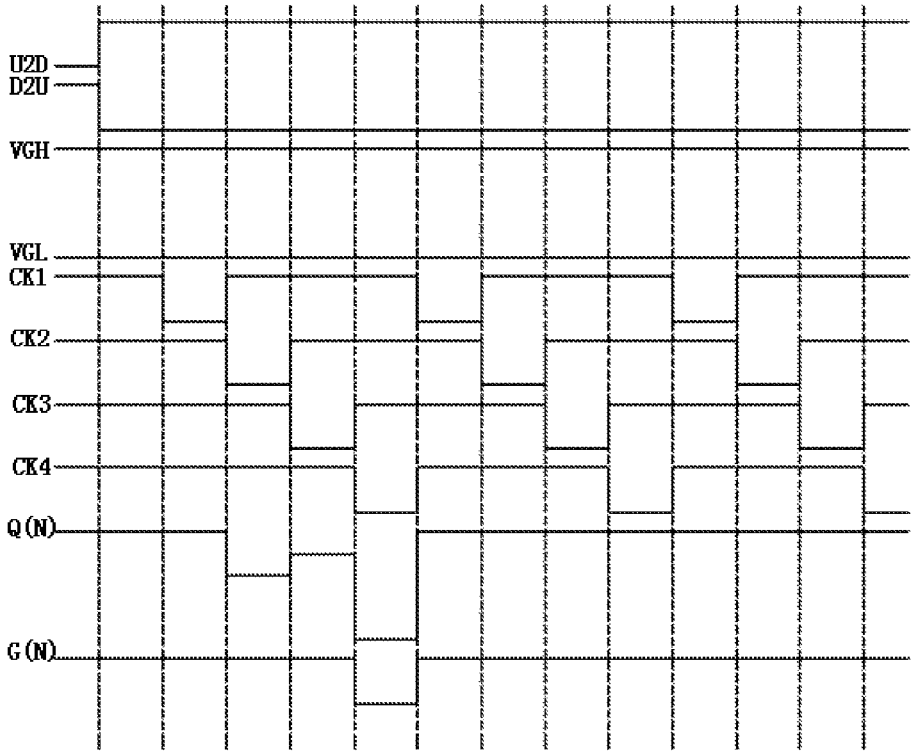
FIG. 6 shows waveforms corresponding to the fifth embodiment in accordance with the driving circuit of the present invention.

The driving circuit of the present invention in accordance with the fifth embodiment is similar to that in accordance with one of the first to fourth embodiments. A difference is described as follows. A signal to be received by the eighth control end 5041 of the eighth switch 504 and a signal to be received by the third control end 4011 of the third switch 401 are exchanged. That is, the eighth control end 5041 of the eighth switch 504 is utilized for receiving the second clock signal CK(N−1) and utilized for controlling the turning on and the turning off of the third current path according to the second clock signal CK(N−1). The third control end 4011 of the third switch 401 is utilized for receiving the third clock signal CK(N−2) and utilized for controlling the turning and the turning off of the eighth current path of the third switch 401 according to the third clock signal CK(N−2). Waveforms corresponding to the present embodiment are shown in FIG. 6.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application. Also, to the extent that the terms "including", "includes", "having", "has", "with", or variants thereof are used in the detailed description and/or in the claims, such terms are intended to be inclusive in a manner similar to the term "comprising".

As is understood by a person skilled in the art, the foregoing preferred embodiments of the present invention are illustrative rather than limiting of the present invention. It is intended that they cover various modifications and similar arrangements be included within the spirit and scope of the appended claims, the scope of which should be accorded the broadest interpretation so as to encompass all such modifications and similar structures.

What is claimed is:

1. A driving circuit, wherein the driving circuit comprises:

at least four drivers, the at least four drivers are electrically coupled in a predetermined sequence, the at least four drivers are utilized for generating driving signals in the predetermined sequence and in a sequence opposite to the predetermined sequence and outputting the driving signals, each of the drivers comprises:

a scan direction control unit;

a driving signal output unit;

a first control unit;

a second control unit;

a third control unit; and a signal output interface, wherein the scan direction control unit is electrically coupled to the second control unit, and the second control unit is electrically coupled to the driving signal output unit, the first control unit, and the third control unit;

the driving signal output unit is utilized for receiving a first clock signal and outputting the driving signal;

the scan direction control unit is utilized for controlling the driving signal output unit to output the driving signal according to an arranged sequence of said driver in the at least four drivers;

the first control unit, the second control unit, and the third control unit are commonly utilized for controlling the driving signal output unit;

the scan direction control unit is utilized for receiving a first control signal, a second control signal, a first input signal, and a second input signal and utilized for outputting the first input signal or the second input signal according to the first control signal and the second control signal;

the scan direction control unit comprises a first switch and a second switch;

a first control end of the first switch is utilized for receiving the first control signal and utilized for controlling a turning on and a turning off of a first current path between a first input end and a first output end of the first switch according to the first control signal;

a second control end of the second switch is utilized for receiving the second control signal and utilized for controlling a turning on and a turning off of a second current path between a second input end and a second output end of the second switch according to the second control signal;

the first input end is utilized for receiving the first input signal, and the second input end is utilized for receiving the second input signal;

the first output end is utilized for outputting the first input signal when the first current path is turned on;

the second output end is utilized for outputting the second input signal when the second current path is turned on;

the first output end of the first switch is electrically coupled to the second output end of the second switch, and the first output end is further electrically coupled to the second control unit;

the second control unit comprises:

a third switch, a third control end of the third switch is utilized for receiving a second clock signal and utilized for controlling a turning on and a turning off of a third current path between a third input end and a third output end of the third switch according to the second clock signal;

the third input end is electrically coupled to the first output end, the third output end is electrically coupled to the driving signal output unit, and the third output end is utilized for outputting the first input signal or the second input signal when the third current path is turned on, wherein the third control unit comprises a fifth switch, a sixth switch, a seventh switch, an eighth switch, and a second capacitor;

an eighth control end of the eighth switch is utilized for receiving a third clock signal and utilized for controlling a turning on and a turning off of an eighth current path between an eighth input end and an eighth output end of the eighth switch according to the third clock signal, the eighth input end is utilized for receiving a low voltage signal, and the eighth output end is electrically coupled to a fifth control end of the fifth switch, and the eighth output end is utilized for outputting the low voltage signal when the eighth current path is turned on;

a seventh control end of the seventh switch is electrically coupled to the third output end, the seventh control end is utilized for receiving the first input signal or the second input signal outputted by the third output end and utilized for controlling a turning on and a turning off of a seventh current path between a seventh input end and a seventh output end according to the first input signal or the second input signal, and the seventh input end is utilized for receiving a high voltage signal;

the seventh output end is electrically coupled to the fifth control end, and the seventh output end is utilized for outputting the high voltage signal when the seventh current path is turned on;

the fifth control end of the fifth switch is utilized for receiving the high voltage signal or the low voltage signal and utilized for controlling a turning on and a turning off of a fifth current path between a fifth input end and a fifth output end of the fifth switch according to the high voltage signal or the low voltage signal, the fifth input end is electrically coupled to the seventh input end, the fifth input end is utilized for receiving the high voltage signal, the fifth output end is electrically coupled to the fourth control end, and the fifth output end is utilized for outputting the high voltage signal when the fifth current path is turned on;

a sixth control end of the sixth switch is electrically coupled to the fifth control end, the sixth control end is utilized for receiving the high voltage signal or the low voltage signal and utilized for controlling a turning on and a turning off of a sixth current path between a sixth input end and a sixth output end of the sixth switch according to the high voltage signal or the low voltage signal;

the sixth input end of the sixth switch is electrically coupled to the seventh input end, the sixth input end is utilized for receiving the high voltage signal, the sixth output end of the sixth switch is electrically coupled to the signal output interface, and the sixth output end is utilized for outputting the high voltage signal when the sixth current path is turned on;

a third plate of the second capacitor is electrically coupled to the sixth control end, and a fourth plate of the second capacitor is electrically coupled to the sixth input end.

2. The driving circuit of claim 1, wherein the first control signal is a first scan direction control signal, the second control signal is a second scan direction control signal, the first input signal is a driving signal outputted by a previous driver adjacent to said driver in the predetermined sequence, and the second input signal is a driving signal outputted by a next driver adjacent to said driver in the predetermined sequence; or the first control signal is the driving signal outputted by the previous driver adjacent to said driver in the predetermined sequence, the second control signal is the driving signal outputted by the next driver adjacent to said driver in the predetermined sequence, the first input signal is the first scan direction control signal, and the second input signal is the second scan direction control signal.

3. The driving circuit of claim 1, wherein the driving signal output unit comprises:

a fourth switch, a fourth control end of the fourth switch is electrically coupled to the third output end, the fourth control end is utilized for receiving the first input signal or the second input signal from the third output end and utilized for controlling a turning on and a turning off of a fourth current path between a fourth input end and a fourth output end of the fourth switch according to the first input signal or the second input signal;

the fourth input end is utilized for receiving the first clock signal;

the fourth output end is electrically coupled to the signal output interface, and the fourth output end is utilized for outputting the first clock signal to the signal output interface when the fourth current path is turned on;

the first control unit comprises a first capacitor, a first plate of the first capacitor is electrically coupled to the fourth control end, and a second plate of the first capacitor is electrically coupled to the fourth output end;

the first capacitor is utilized for receiving the first input signal or the second input signal, storing the first input signal or the second input signal, receiving the driving signal, and combining the driving signal with the first input signal or the second input signal to generate a third control signal, and the third control signal is utilized for controlling the turning on and the turning off the fourth current path.

4. The driving circuit of claim 1, wherein the third control unit further comprises a ninth switch;

a ninth control end of the ninth switch is utilized for receiving a fourth clock signal and utilized for controlling a turning on and a turning off of a ninth current path between a ninth input end and a ninth output end of the ninth switch according to the fourth clock signal;

the ninth input end is electrically coupled to the eighth input end, the ninth output end is electrically coupled to the eighth output end, and the ninth output end is utilized for outputting the low voltage signal when the ninth current path is turned on;

the second control unit comprises:

a tenth switch, a tenth input end of the tenth switch is electrically coupled to the first output end, a tenth control end of the tenth switch is electrically coupled to the tenth input end, and a tenth output end of the tenth switch is electrically coupled to the third input end of the third switch.

5. A driving circuit, wherein the driving circuit comprises:

at least four drivers, the at least four drivers are electrically coupled in a predetermined sequence, the at least four drivers are utilized for generating driving signals in the predetermined sequence and in a sequence opposite to the predetermined sequence and outputting the driving signals, each of the drivers comprises:

a scan direction control unit;

a driving signal output unit;

a first control unit;

a second control unit;

a third control unit; and a signal output interface, wherein the scan direction control unit is electrically coupled to the second control unit, and the second control unit is electrically coupled to the driving signal output unit, the first control unit, and the third control unit;

the driving signal output unit is utilized for receiving a first clock signal and outputting the driving signal;

the scan direction control unit is utilized for controlling the driving signal output unit to output the driving signal according to an arranged sequence of said driver in the at least four drivers;

the first control unit, the second control unit, and the third control unit are commonly utilized for controlling the driving signal output unit, wherein the scan direction control unit is utilized for receiving a first control signal, a second control signal, a first input signal, and a second input signal and utilized for outputting the first input signal or the second input signal according to the first control signal and the second control signal, wherein the second control unit comprises:

a third switch, a third control end of the third switch is utilized for receiving a second clock signal and utilized for controlling a turning on and a turning off of a third current path between a third input end and a third output end of the third switch according to the second clock signal;

the third input end is electrically coupled to the first output end, the third output end is electrically coupled to the driving signal output unit, and the third output end is utilized for outputting the first input signal or the second input signal when the third current path is turned on, wherein the third control unit comprises a fifth switch, a sixth switch, a seventh switch, an eighth switch, and a second capacitor;

an eighth control end of the eighth switch is utilized for receiving a third clock signal and utilized for controlling a turning on and a turning off of an eighth current path between an eighth input end and an eighth output end of the eighth switch according to the third clock signal, the eighth input end is utilized for receiving a low voltage signal, and the eighth output end is electrically coupled to a fifth control end of the fifth switch, and the eighth output end is utilized for outputting the low voltage signal when the eighth current path is turned on;

a seventh control end of the seventh switch is electrically coupled to the third output end, the seventh control end is utilized for receiving the first input signal or the second input signal outputted by the third output end and utilized for controlling a turning on and a turning off of a seventh current path between a seventh input end and a seventh output end according to the first input signal or the second input signal, and the seventh input end is utilized for receiving a high voltage signal;

the seventh output end is electrically coupled to the fifth control end, and the seventh output end is utilized for outputting the high voltage signal when the seventh current path is turned on;

the fifth control end of the fifth switch is utilized for receiving the high voltage signal or the low voltage signal and utilized for controlling a turning on and a turning off of a fifth current path between a fifth input end and a fifth output end of the fifth switch according to the high voltage signal or the low voltage signal, the fifth input end is electrically coupled to the seventh input end, the fifth input end is utilized for receiving the high voltage signal, the fifth output end is electrically coupled to the fourth control end, and the fifth output end is utilized for outputting the high voltage signal when the fifth current path is turned on;

a sixth control end of the sixth switch is electrically coupled to the fifth control end, the sixth control end is utilized for receiving the high voltage signal or the low voltage signal and utilized for controlling a turning on and a turning off of a sixth current path between a sixth input end and a sixth output end of the sixth switch according to the high voltage signal or the low voltage signal;

the sixth input end of the sixth switch is electrically coupled to the seventh input end, the sixth input end is utilized for receiving the high voltage signal, the sixth output end of the sixth switch is electrically coupled to the signal output interface, and the sixth output end is utilized for outputting the high voltage signal when the sixth current path is turned on;

a third plate of the second capacitor is electrically coupled to the sixth control end, and a fourth plate of the second capacitor is electrically coupled to the sixth input end.

6. The driving circuit of claim 5, wherein the driving signal output unit comprises:

a fourth switch, a fourth control end of the fourth switch is electrically coupled to the third output end, the fourth control end is utilized for receiving the first input signal or the second input signal from the third output end and utilized for controlling a turning on and a turning off of a fourth current path between a fourth input end and a fourth output end of the fourth switch according to the first input signal or the second input signal;

the fourth input end is utilized for receiving the first clock signal;

the fourth output end is electrically coupled to the signal output interface, and the fourth output end is utilized for outputting the first clock signal to the signal output interface when the fourth current path is turned on.

7. The driving circuit of claim 6, wherein the first control unit comprises a first capacitor, a first plate of the first capacitor is electrically coupled to the fourth control end, and a second plate of the first capacitor is electrically coupled to the fourth output end;

the first capacitor is utilized for receiving the first input signal or the second input signal, storing the first input signal or the second input signal, receiving the driving signal, and combining the driving signal with the first input signal or the second input signal to generate a third control signal, and the third control signal is utilized for controlling the turning on and the turning off the fourth current path.

8. The driving circuit of claim 5, wherein the second plate is further electrically coupled to the sixth output end;

the second plate is further utilized for receiving the high voltage signal from the sixth output end and neutralizing electric charges corresponding to the high voltage signal and electric charges corresponding to the first input signal or the second input signal received by the first plate, so as to generate the third control signal and control a voltage potential at a first predetermined position in a connection between the driving signal output unit and the scan direction control unit.

9. The driving circuit of claim 5, wherein the third plate is utilized for receiving electric charges corresponding to the low voltage signal, the fourth plate is utilized for receiving electric charges corresponding to the high voltage signal, a fourth control signal is generated after the electric charges in the third plate and the electric charges in the fourth plate are neutralized, and the fourth control signal is utilized for controlling the turning on and the turning off of the sixth current path.

10. The driving circuit of claim 5, wherein the second capacitor is further utilized for storing electric charges of the low voltage signal inputted by the eighth switch and utilized for increasing a voltage potential of a second predetermined position between the eighth output end and the sixth control end by using the stored electric charges.

11. The driving circuit of claim 5, wherein a signal to be received by the eighth control end of the eighth switch and a signal to be received by the third control end of the third switch are exchanged.

12. The driving circuit of claim 5, wherein the third control unit further comprises a ninth switch;

a ninth control end of the ninth switch is utilized for receiving a fourth clock signal and utilized for controlling a turning on and a turning off of a ninth current path between a ninth input end and a ninth output end of the ninth switch according to the fourth clock signal;

the ninth input end is electrically coupled to the eighth input end, the ninth output end is electrically coupled to the eighth output end, and the ninth output end is utilized for outputting the low voltage signal when the ninth current path is turned on.

13. The driving circuit of claim 5, wherein the second control unit comprises:

a tenth switch, a tenth input end of the tenth switch is electrically coupled to the first output end, a tenth control end of the tenth switch is electrically coupled to the tenth input end, and a tenth output end is electrically coupled to the third input end of the third switch.

14. The driving circuit of claim 5, wherein the second control unit is further utilized for avoiding and decreasing a leakage current at a first predetermined position of a connection between the driving signal output unit and the scan direction control unit.

* * * * *